US011359394B2

(12) United States Patent
Dicaire et al.

(10) Patent No.: US 11,359,394 B2
(45) Date of Patent: Jun. 14, 2022

(54) ALIGNMENT HEAD FOR AUTOMATIC FASTENER FEED INSTALLATION TOOL

(71) Applicant: OMG, Inc., Agawam, MA (US)

(72) Inventors: Mark A. Dicaire, Boylston, MA (US); Mark J. Guthrie, West Springfield, MA (US)

(73) Assignee: OMG, Inc., Agawam, MA (US)

( * ) Notice: Subject to any disclaimer, the term of this patent is extended or adjusted under 35 U.S.C. 154(b) by 139 days.

(21) Appl. No.: 16/832,724

(22) Filed: Mar. 27, 2020

(65) Prior Publication Data

US 2020/0308855 A1 Oct. 1, 2020

Related U.S. Application Data

(60) Provisional application No. 62/824,538, filed on Mar. 27, 2019.

(51) Int. Cl.
*E04G 21/18* (2006.01)
*B25H 7/04* (2006.01)

(52) U.S. Cl.
CPC ..... *E04G 21/185* (2013.01); *B25H 7/04* (2013.01)

(58) Field of Classification Search
CPC ..... E04G 21/185; B25H 7/04; B25C 3/006; B25C 7/00; B25F 5/021
USPC ..... 33/562
See application file for complete search history.

(56) References Cited

U.S. PATENT DOCUMENTS

| | | | | |
|---|---|---|---|---|
| 4,467,523 | A * | 8/1984 | Chisholm | H05K 13/0478 29/564.6 |
| 5,004,141 | A * | 4/1991 | Young | B23P 19/003 227/112 |
| 5,819,412 | A * | 10/1998 | Olden | E04C 3/292 29/897.31 |
| 9,662,754 | B2 * | 5/2017 | Beaty | B25B 23/06 |
| 10,414,030 | B2 * | 9/2019 | Vandenberg | F16B 27/00 |
| 10,421,176 | B2 * | 9/2019 | Vandenberg | B25B 21/002 |
| 10,850,373 | B2 * | 12/2020 | Vandenberg | B25B 23/005 |
| 10,920,432 | B2 * | 2/2021 | Demuth | E04B 1/003 |
| 2007/0226980 | A1 * | 10/2007 | Lachowski | B25B 31/00 29/225 |
| 2017/0239794 | A1 * | 8/2017 | Vandenberg | B25B 21/002 |
| 2017/0239795 | A1 * | 8/2017 | Vandenberg | B25C 1/003 |
| 2017/0241464 | A1 * | 8/2017 | Vandenberg | B25B 23/045 |
| 2019/0071880 | A1 * | 3/2019 | Demuth | E04B 1/003 |
| 2020/0308855 | A1 * | 10/2020 | Dicaire | B25F 5/021 |
| 2021/0301543 | A1 * | 9/2021 | Carlson | E04F 15/02183 |

* cited by examiner

*Primary Examiner* — Yaritza Guadalupe-McCall
(74) *Attorney, Agent, or Firm* — Alix, Yale & Ristas, LLP

(57) ABSTRACT

An alignment head for an automatic fastener feed installation tool employs a platform with spring biased retractable pins and a central opening. The retractable pins are spaced to protrude downwardly and engage opposing sides of a support joist. The central opening receives the fastener which is automatically positioned for driving at an entry position into a deck board overlying the joist. The fastener is drivable into the joist at a medial position of the joist and a pre-established position from the edge of a deckboard. The pins also define the spacing of the adjacent deck board. In one embodiment, the alignment head is employed for securing the deck boards at a consistent 45° angle to the joist.

20 Claims, 10 Drawing Sheets

ALIGNMENT HEAD FOR AUTOMATIC FASTENER FEED INSTALLATION TOOL

CROSS-REFERENCE TO RELATED APPLICATION

This application claims the priority of U.S. Provisional Patent Application No. 62/824,538 filed on Mar. 27, 2019, the disclosure of which is incorporated herein in its entirety.

BACKGROUND

When installing a deck, it is important that measurements and spacing are accurate and consistent. Deck boards should have a standard spacing between one another, as well as proper placement of fasteners for securement integrity. In order to achieve consistency and accuracy in deck board and fastener spacing, typically one must measure and space each fastener that secures a deck board to a support joist. Due to the large number of fasteners required to secure multiple deck boards to multiple support joists when installing a deck, manually measuring and spacing each fastener can be laborious and prone to error. Therefore, it would be useful to have a device capable of efficiently measuring and properly spacing fasteners when securing a deck board to a support joist so that uniform gaps and fastener locations may be replicated throughout the installation.

SUMMARY OF THE INVENTION

An alignment head for an automatic fastener feed installation tool (hereinafter "alignment head") accurately locates a fastener when securing a deck board to a support joist using an automatic fastener feed installation tool. The alignment head has a platform with a central opening for receiving and mounting to an automatic fastener feed installation tool. A rectangular matrix of retractable guide assemblies are mounted to the platform of the alignment head. In one embodiment, each retractable guide assembly has a guide leg in the form of a pin that cooperates with a coiled spring or bias member within a cylindrical shroud to bias the pin downward to project below the platform. The cylindrical shroud preferably has an opening on its top end. The cylindrical shroud and the coiled spring are preferably positioned on top of the platform. In some embodiments, the shroud is not cylindrical. The pins aid in properly locating the fastener for driving and in spacing an adjacent deck board.

The platform is placed on the deck board and selectively positioned. Each pin is biased to protrude downwardly through and below the platform unless the lower end is obstructed by the deck board. When the lower end of the pin is in contact with a deck board below the platform, the pin retracts upward into the platform and through the opening in the top end of the shroud.

Each retractable guide assembly is radially offset from the central opening of the platform. There are preferably four substantially identical retractable guide assemblies. The central opening in the platform is preferably circular and includes a channel which extends out to a side of the platform. In an alternative embodiment, the central opening in the platform is rectangular and includes a channel which extends out to a side of the platform. The platform preferably has a top surface and a parallel bottom surface that defines a substantially planar reference. The top surface of the platform preferably includes an arcuate groove that extends throughout the channel.

In use, the alignment head is mounted to an automatic fastener feed installation tool by securement at the central opening of the alignment head. The alignment head is positioned on the deck board as required. A first pair of pins project downward from the platform and extend into a gap between deck boards or on the outside of a deck board and press against an edge of the deck board in which a fastener is to be driven.

The platform lies flat atop the plane of the deck board. For some installations, a second set of pins that are also atop the plane of the deck board retract upward due to contact with the deck board so that the platform can remain flat atop the deck board. Collated fasteners are fed by the automatic fastener feed installation tool through the channel in the platform. The arcuate groove that extends throughout the channel alleviates potential interference by the platform. The fasteners are fed through the channel until they reach the central opening where a fastener is positioned and driven into the deck board. The fastener is driven at a pre-established standardized distance from the pin at the edge of the deck board.

The pins, at least on their lower portions, preferably have the same effective maximum diameters. The diameter of each pin also implements and defines a standardized spacing or gap in between deck boards while engaging opposite sides of the support joist.

BRIEF DESCRIPTION OF THE DRAWINGS

Embodiments of the disclosed alignment head will be described in greater detail below with reference to the accompanying drawings and photographs, in which.

DETAILED DESCRIPTION

Figure 9:
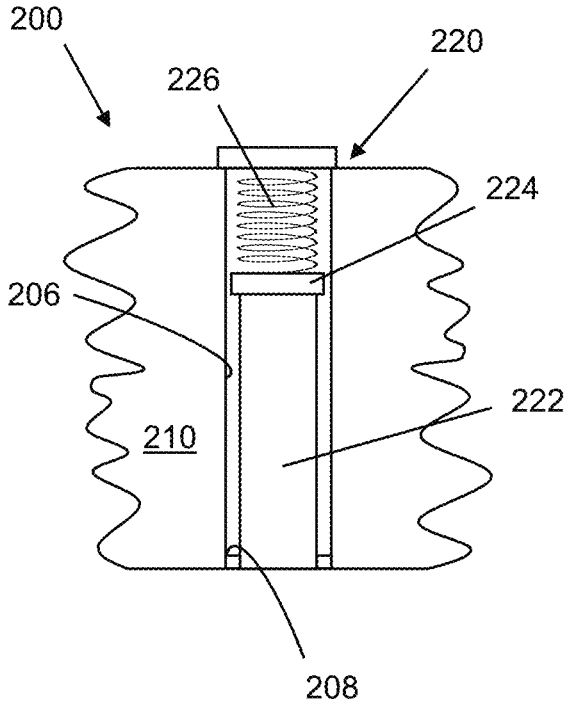
FIG. 9 is an enlarged fragmentary sectional view of the alignment head of FIG. 10 with the guide leg in a retracted mode.

With reference to the drawings and photographs, wherein like numerals represent like parts, an alignment head for an automatic fastener feed installation tool (hereinafter "alignment head") 50 is disclosed herein. In selected drawings, some components are also designated with letter suffixes for explanatory purposes. The alignment head 50 is configured to accurately measure and space a fastener when securing a deck board $B_2$ to a support joist $S_1$ using an automatic fastener feed installation tool. The alignment head 50 is configured to install the deck board $B_2$ to the support joist $S_1$ at 90°. A representative fastener feed installation tool 500 is depicted in FIG. 9.

In a preferred embodiment, the alignment head 50 is comprised of a platform 10 and a rectangular matrix of retractable guide assemblies 20. As shown, the platform 10 has parallel top and bottom surfaces which are preferably substantially flat. The bottom surface defines a planar reference structure. Defined within the platform 10 is a central opening 12. The central opening 12 includes a channel 14 that extends out to a side. The top surface of the platform 10 preferably includes an arcuate groove 25 that extends throughout the channel 14. The central opening 12 may be rectilinear as illustrated or may have a cylindrical or other configuration.

In one embodiment, the retractable guide assemblies 20 are substantially identical and are radially offset from the central opening 12. The retractable guide assemblies 20 each have a retractable guide leg in the form of a pin 22, a cylindrical shroud 24, secured to and projecting above the platform and a coiled spring 26 biasing the pin 22 downwardly to project below the platform. The cylindrical shroud 24 defines a central opening 28 at its top end. The cylindrical shroud 24 housing the coiled spring 26 and at least an upper portion of the pin 22 are preferably positioned above the platform 10. The pin 22 extends through the platform 10. Each shroud is preferably identical in shape, but need not be cylindrical, and for some embodiments described below, is not required.

For explanatory purposes, the retractable guide assemblies and the components thereof are designated by the letters A, B, C and D to designate their positions on alignment head 50. As shown in FIG. 1B, the pins 22A and 22B are biased by a spring to protrude downwardly below the platform 10 when the pin 22 is not in contact with the deck board $B_2$. As shown in FIG. 1C, the pin 22C retracts upwardly into the platform 10 against the bias of the spring and up through the opening 28C in the top end of the shroud 24C when the lower end of the pin 22C is in contact with the deck board $B_2$. Pin 22D would likewise retract when the head is in the FIG. 1 position.

Figure 1:
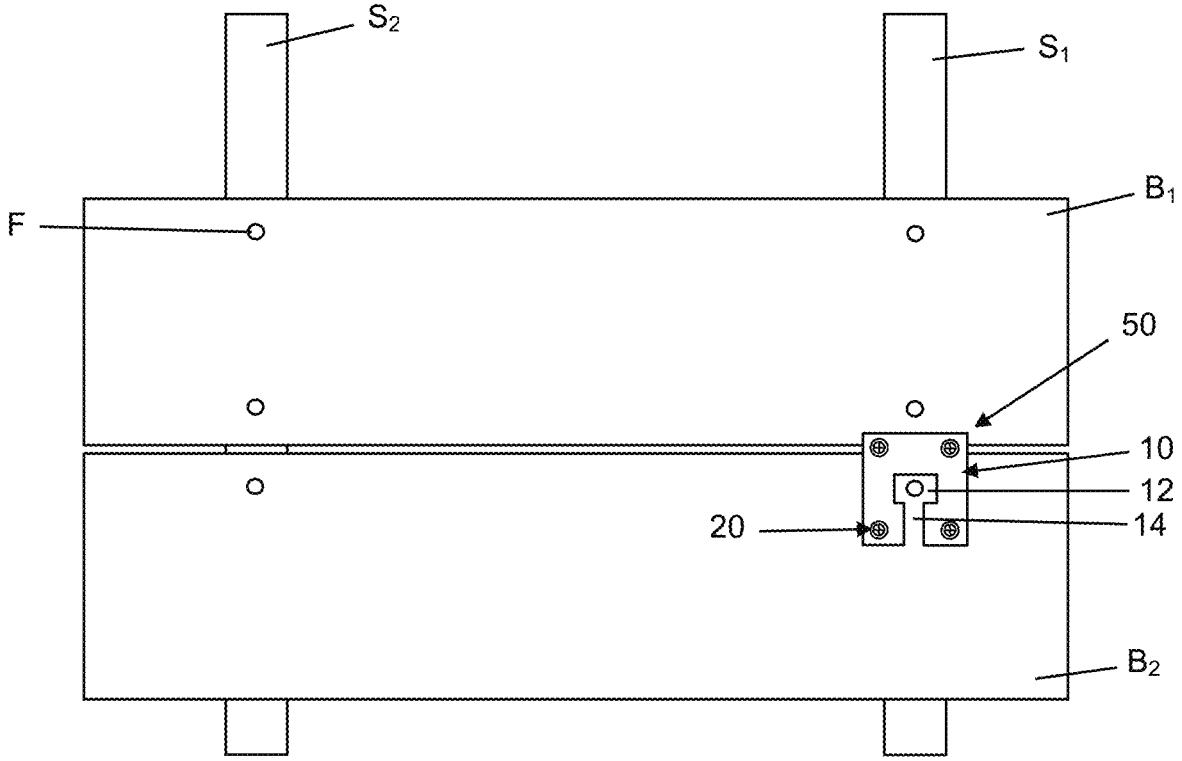
FIG. 1 is a top view of an alignment head for installing deck boards at 90° to support joists ("90° alignment head") together with portions of two deck boards and two joists and positioned about a gap between two deck boards.
Figure 1B:
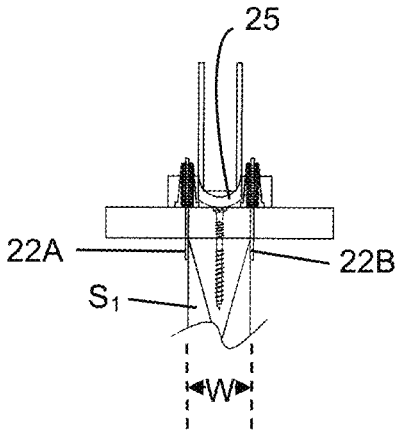
FIG. 1B is a front view of the 90° alignment head, with two retractable guide legs not in contact with a deck board, protruding downward in a gap between two deck boards.
Figure 1C:
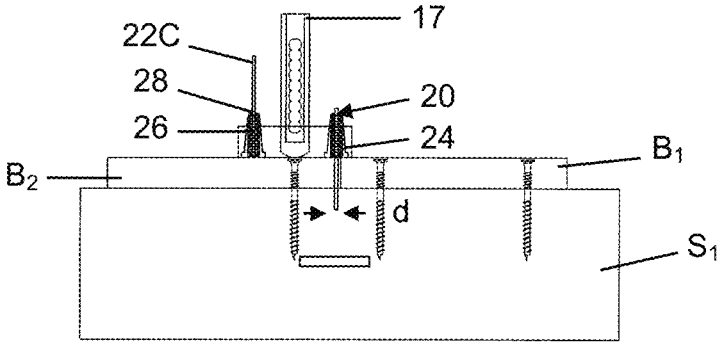
FIG. 1C is a side view of the 90° alignment head, with one or more of the retractable guide legs in contact with a deck board retracted upwardly and one or more of the retractable guide legs not in contact with a deck board protruding downwardly in a gap between two deck boards.
Figure 1A:
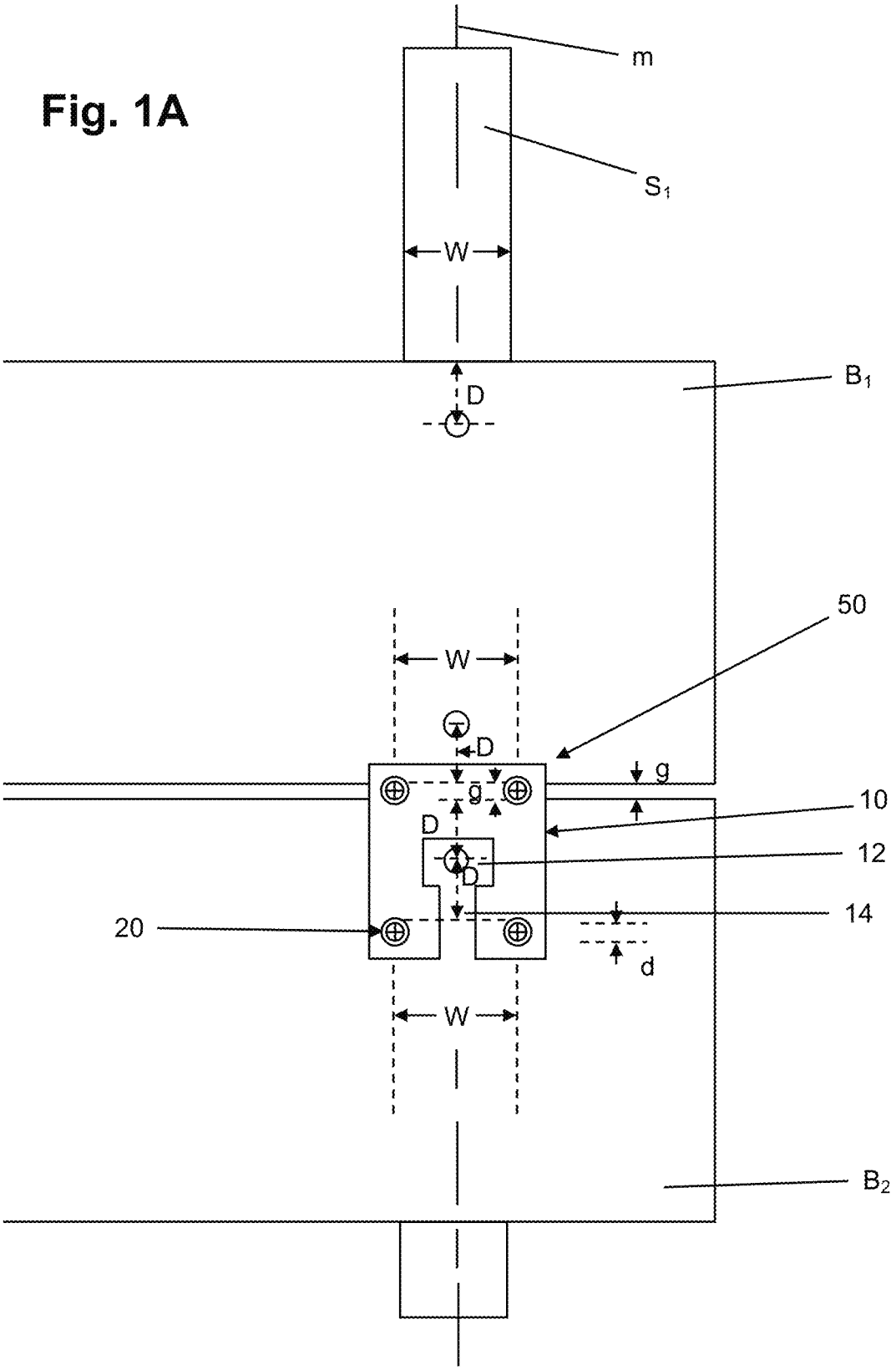
FIG. 1A is an enlarged diagrammatic fragmentary view of the 90° alignment head, joist and deck boards of FIG. 1.
Figure 1D:
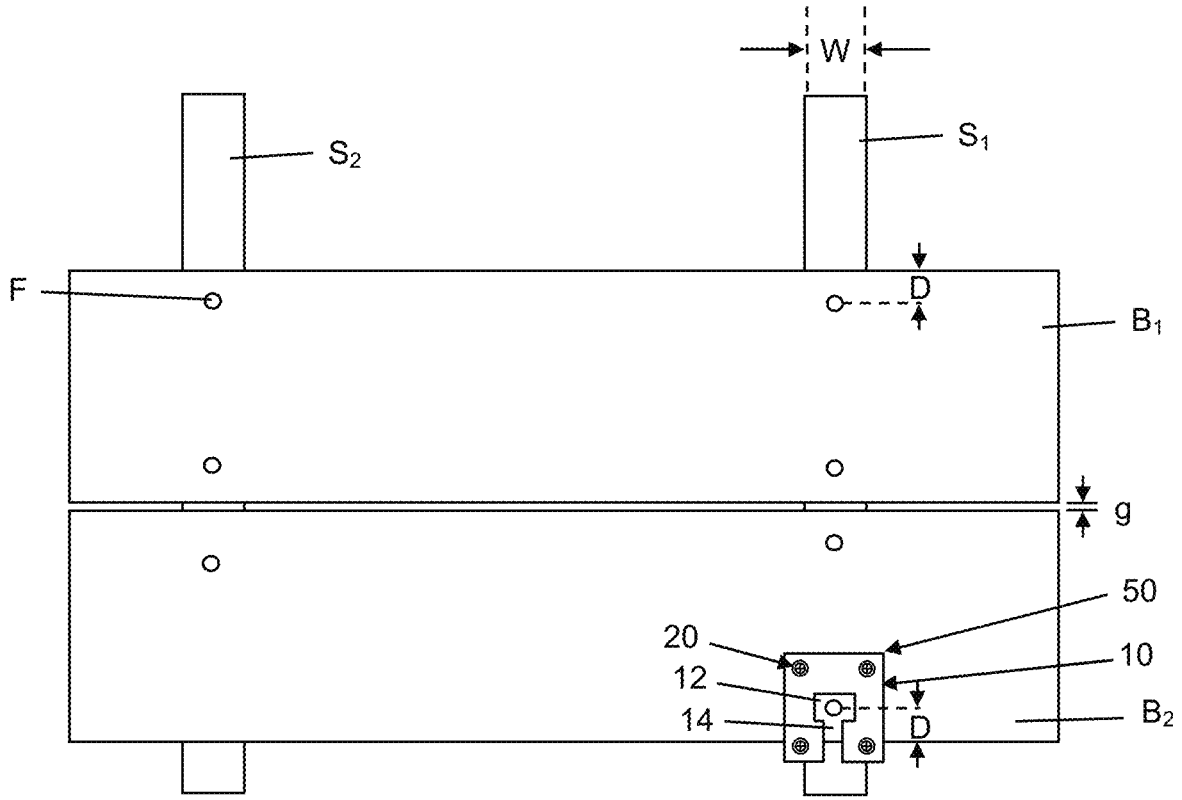
FIG. 1D is a top view of the 90° alignment head, about an edge of a deck board.
Figure 1E:
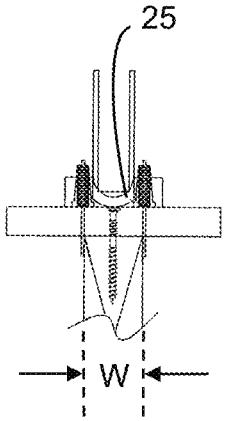
FIG. 1E is a front view of the 90° alignment head, with two retractable guide legs not in contact with a deck board, protruding downwardly about an edge of the deck board.
Figure 1F:
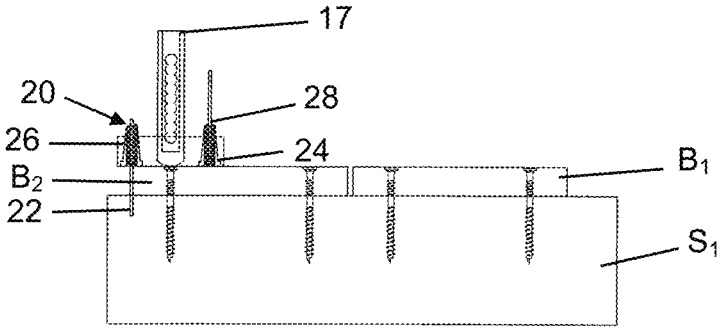
FIG. 1F is a side view of the 90° alignment head, with one or more of the retractable guide legs in contact with a deck board retracted upwardly and one or more of the retractable guide legs not in contact with a deck board protruding downwardly about an edge of a deck board.
Figure 2A:
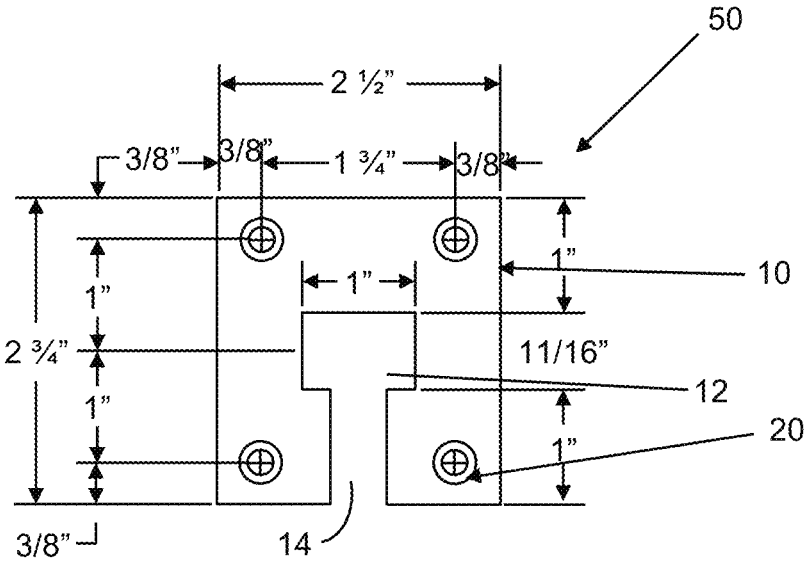
FIG. 2A is a diagrammatic top view of the 90° alignment head, with preferred dimensions.
Figure 2B:
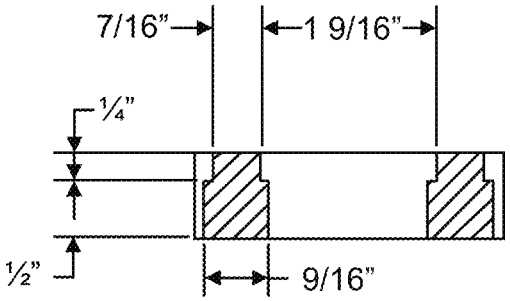
FIG. 2B is a diagrammatic side view of the 90° alignment head, with preferred dimensions.
Figure 2C:
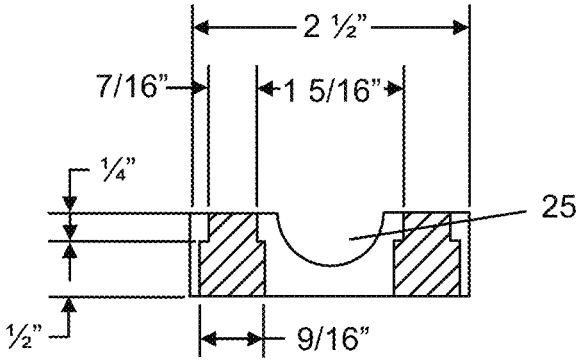
FIG. 2C is a diagrammatic front view of the 90° alignment head, with preferred dimensions.

With reference to FIGS. 1 and 1A, the retractable guide assemblies 20 aid in providing consistent and accurate spacing when installing the deck board $B_2$ to the support joist $S_1$. A lower portion of each pin 22 preferably has a maximum effective diameter d of 3/16 or 1/4 of an inch. This effective diameter d allows for accurate replicative spacing of gap g between deck boards $B_1$ and $B_2$.

The retractable guide assemblies 20 and the central opening 12 are also spaced from each other at a standardized distance D such that a fastener is driven at a consistent and correct position within the plane of the deck board $B_2$ and at a medial entry position of the joist. The medial line of support joist $S_1$ is designated by m in FIG. 1A. In a preferred embodiment, such as illustrated in FIG. 1B, the pins 22A and 22B are transversely spaced a distance equal to the width W of the support joist $S_1$, so that the alignment head straddles the joist $S_1$, and centers the fastener on the medial plane of the joist for driving the fasteners into the deck board and joist.

The retractable guide assemblies 20 also aid in locating the edge of the next installed deck board $B_2$. The retractable guide pin 22 has a uniform effective dimension or diameter d. The pre-established pin diameter d functions to optionally locate the edge of the deck board $B_2$ by pressing flush against a side of the deck board $B_2$. The retractable guide pins 22 that are within the plane of the deck board $B_2$ are forced to retract upwardly so that the platform 10 can lie flat atop the deck board $B_2$. Being capable of extending downward and retracting upward, the retractable guide pins 22 allow for proper spacing in between the deck boards $B_1$ and $B_2$ (gap g), consistent fastener positioning (at a distance D from the board edge) within the plane of the deck board $B_2$ and proper securement fastener positioning and driving into the deck board $B_2$ at a medial position of the support joist $S_1$. Upon replicating the positioning of the alignment head and the driving of fasteners throughout the installation process, the foregoing also provides an aesthetically pleasing deck installation.

As shown in FIGS. 4-8, the alignment head 50 is mounted to an automatic fastener feed installation tool through its central opening 12'. The central opening 12' is cylindrical in shape. The alignment head 50 mounts to a pair of brackets 17 that project through the central opening 12. When mounted, the channel 14 of the platform 10 extends in a rearward direction. The channel 14 ensures sufficient headroom for collated fasteners to pass to the central opening 12. The arcuate groove 25 minimizes the potential for the platform 10 to interfere with the passage of the collated fasteners through the channel 14. The collated fasteners travel through the channel 14 until they reach the central opening 12 where they are driven into the deck board $B_2$ and support joist.

As shown in FIGS. 3A-3D, an alignment head 100 may also be configured to install fasteners at 45°. As in the previous embodiment for alignment head 50, alignment head 100 includes a platform 102, a central opening 104 and a plurality of parallel retractable guide assemblies 106 designated 106E, 106F, 106G and 106H to identify positions. The guide assemblies 106 are preferably positioned on the platform 102 in a trapezoidal matrix. In this embodiment, the platform 102 generally is principally defined by an elongated side 110, an opposite elongated side 112, an angled side 114, a channel 108 extending from the central opening 104 out to a side and an arcuate groove 125 extending throughout the top side of the channel 108.

For alignment head 100, the retractable guide assemblies 106 are radially offset from the central opening 104. Similar to corresponding structures of alignment head 50, the retractable guide assemblies 106 are substantially identical wherein each has a retractable guide leg in the form of a pin 22, a shroud 24, and a coiled spring 26 which exerts a downward biasing force on the pin. The shroud 24 defines an opening 28 at its top end. The shroud 24, coiled spring 26 and an upper portion of pin 22 are positioned atop the platform 102. Each pin 22 extends from the position atop the platform 102 and at least through the platform 102.

The pins 22 of the guide assembly pair 106E and 106F are spaced to straddle opposite sides of the support joist $S_3$. Likewise, the pins 22 of the guide assemblies 106G and 106H are spaced to straddle opposite sides of the support joist $S_3$ having a medial line m. The diagonal spacing b between the pins of retractable assemblies 106E and 106F and between 106G and 106H is approximately $\sqrt{2}$ times the width W or 1.414 times the width W.

Figure 3B:
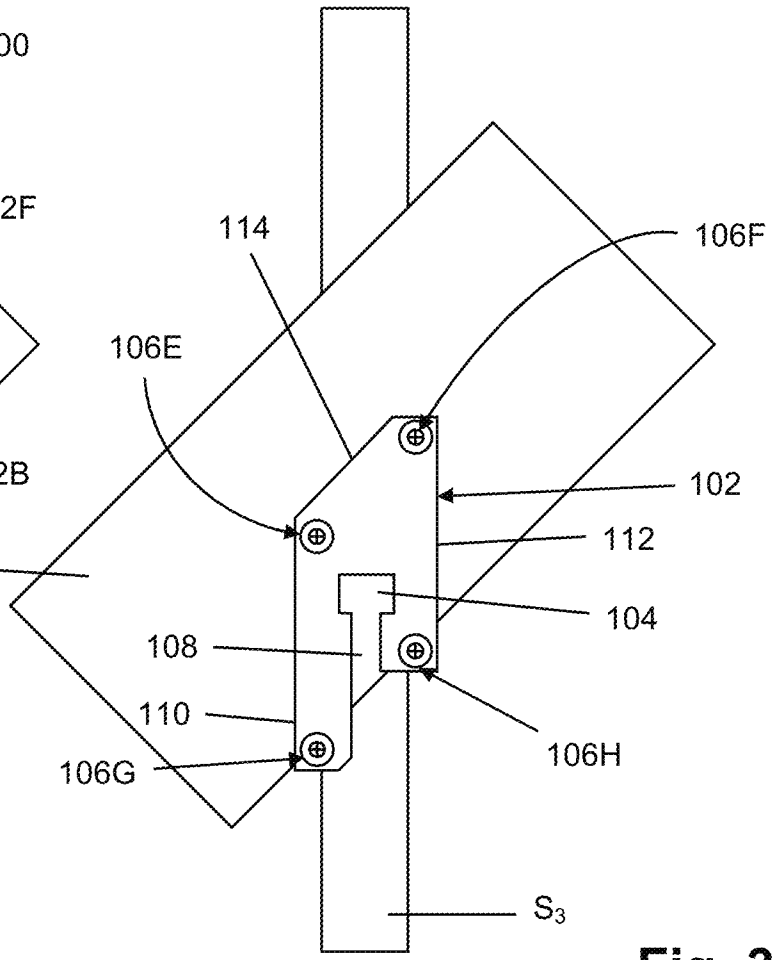
FIG. 3B is a top view of the 45° alignment head in another position together with portions of a deck board and a joist.
Figure 3A:
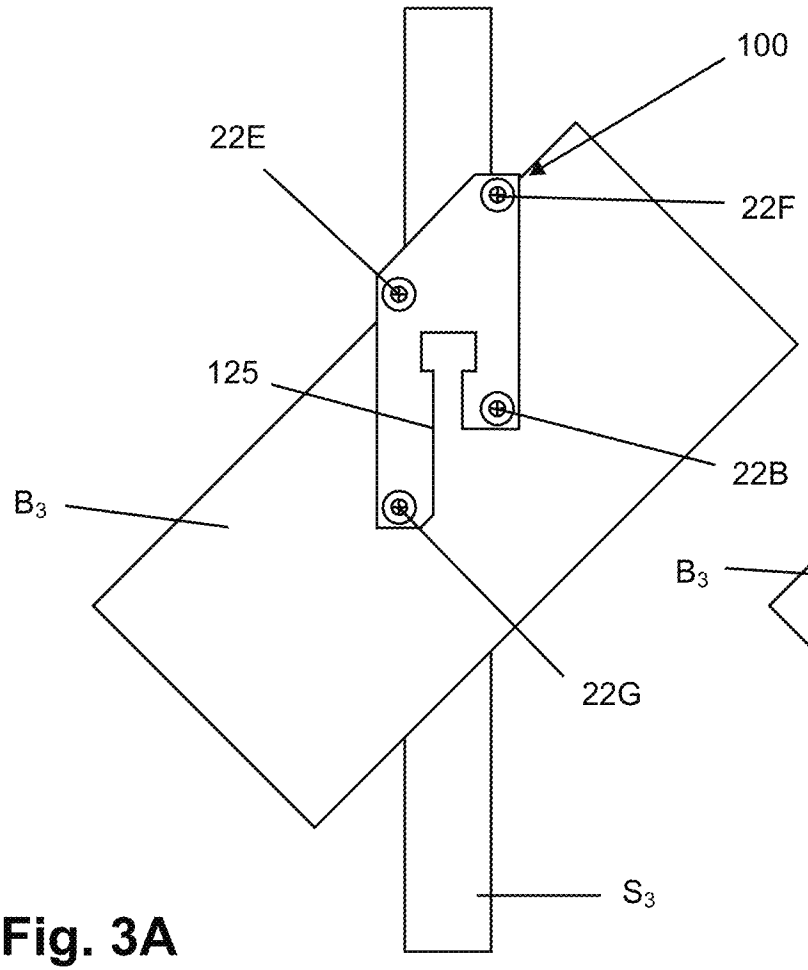
FIG. 3A is a top view of an alignment head for installing deck boards at 45° to support joists ("45° alignment head") in one position together with portions of a deck board and a joist.
Figure 3D:
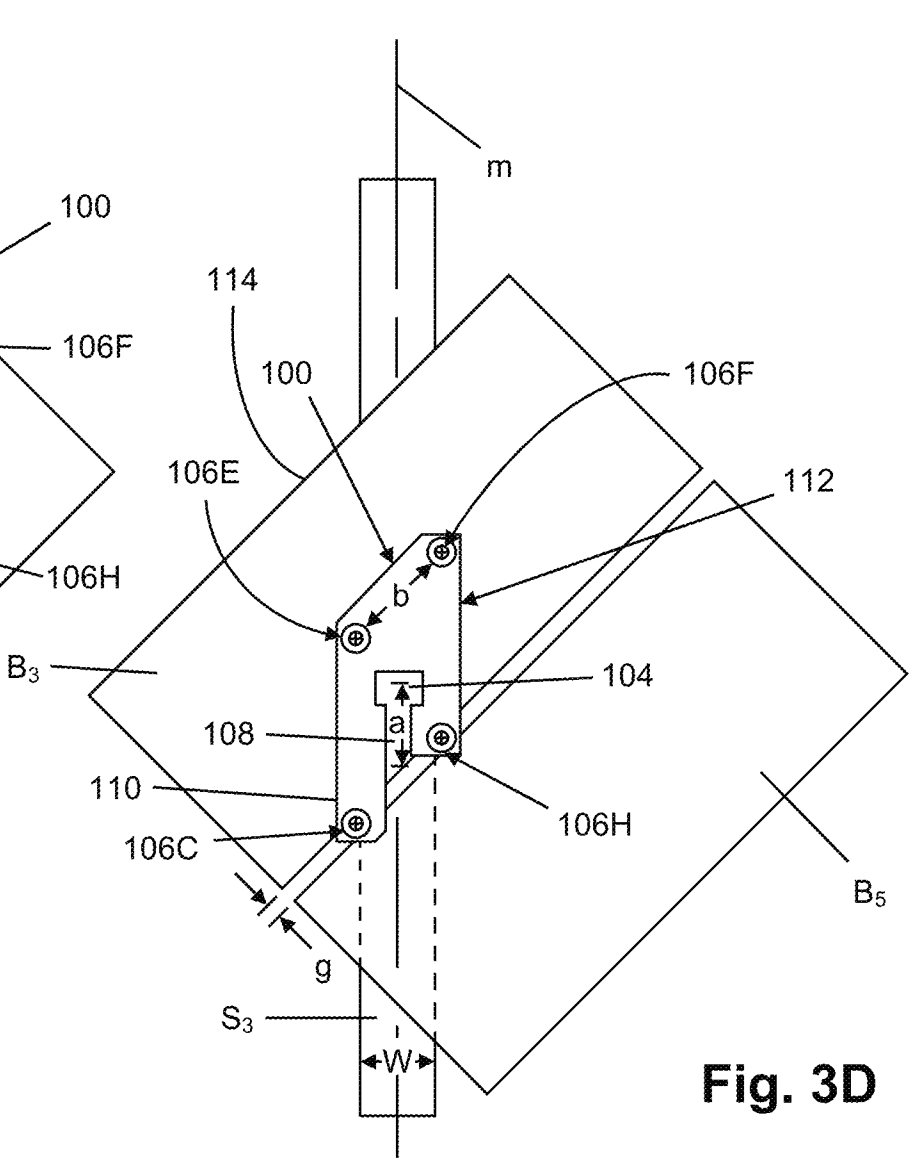
FIG. 3D is a diagrammatic top view of the installation of FIG. 3B together with a second deck board.
Figure 3C:
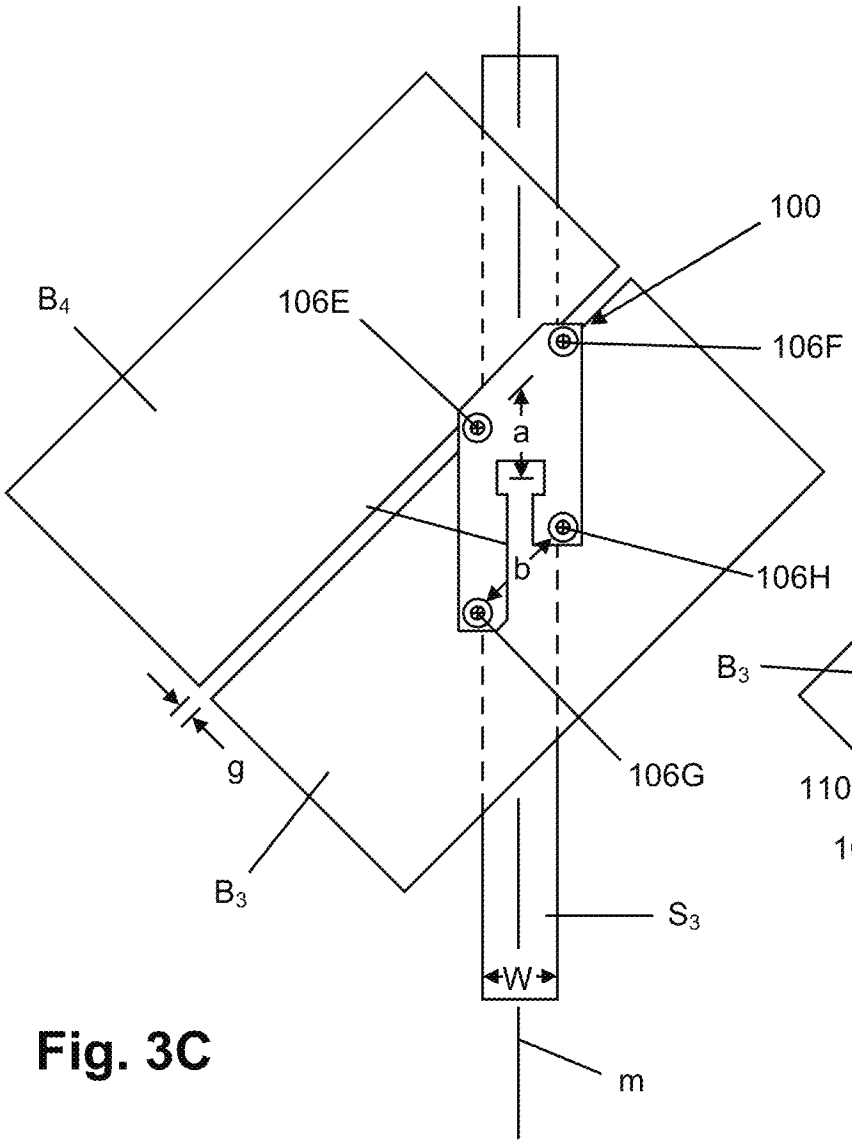
FIG. 3C is a diagrammatic top view of the installation of FIG. 3A together with a second deck board.

With reference to FIGS. 3A and 3C, the pins 22E and 22F protrude downwardly below the platform 102 due to the bias of a corresponding spring 26 when the corresponding pin 22 is not in contact with an underlying deck board $B_3$. The pins 22G and 22H retract upwardly into the platform 102 and up through the opening 28 in the top end of the cylindrical shroud 24 when the lower portion of each corresponding pin 22 contacts against the upper surface of the underlying deck board $B_3$.

For alignment head 100, the retractable guide assemblies 106 aid in providing consistent and accurate spacing when installing the deck board $B_4$ to support joist $S_3$ at a 45° angle. The maximum effective diameter of the lower portion of each pin 22 is preferably 3/16 or 1/4 of an inch in diameter. This effective diameter allows for accurate and consistent spacing or gap g in between each deck board. The retractable guide legs 106 and the central opening 104 are also spaced from each other at a standardized distance a such that a fastener F is driven at a consistent and optimal position on the median m of support joist $S_3$ and perpendicular within the plane of the deck board $B_3$.

With reference to FIGS. 3A, 3B, 3C and 3D, the retractable guide assemblies 106 form a trapezoidal matrix and also aid in locating the edge of the next installed deck board $B_5$. The retractable guide assemblies 106 locate the edge of the deck board at the 45° angle by the installer positioning the alignment head 100 so the side of the deck board $B_5$ is pressed flush against pins of retractable guide assemblies 106G and 106H. The retractable guide assemblies 106E and 106F that are within the plane of the deck board $B_3$ retract upwardly so that the platform 102 can lie flat atop the deck board $B_3$. Being capable of extending downwardly and retracting upwardly as dictated by the installation task, the retractable guide assemblies 106 function to implement proper spacing between the deck board $B_3$ and another adjacent deck board ($B_4$ or $B_5$), provide consistent fastener positioning within the plane of the deck board $B_3$ and ensure driving of a fastener into the deck board $B_3$ and the underlying support joist $S_3$ on the median m at a consistent spacing a from the edge of the board to effect a high degree of securement integrity.

Figure 4:
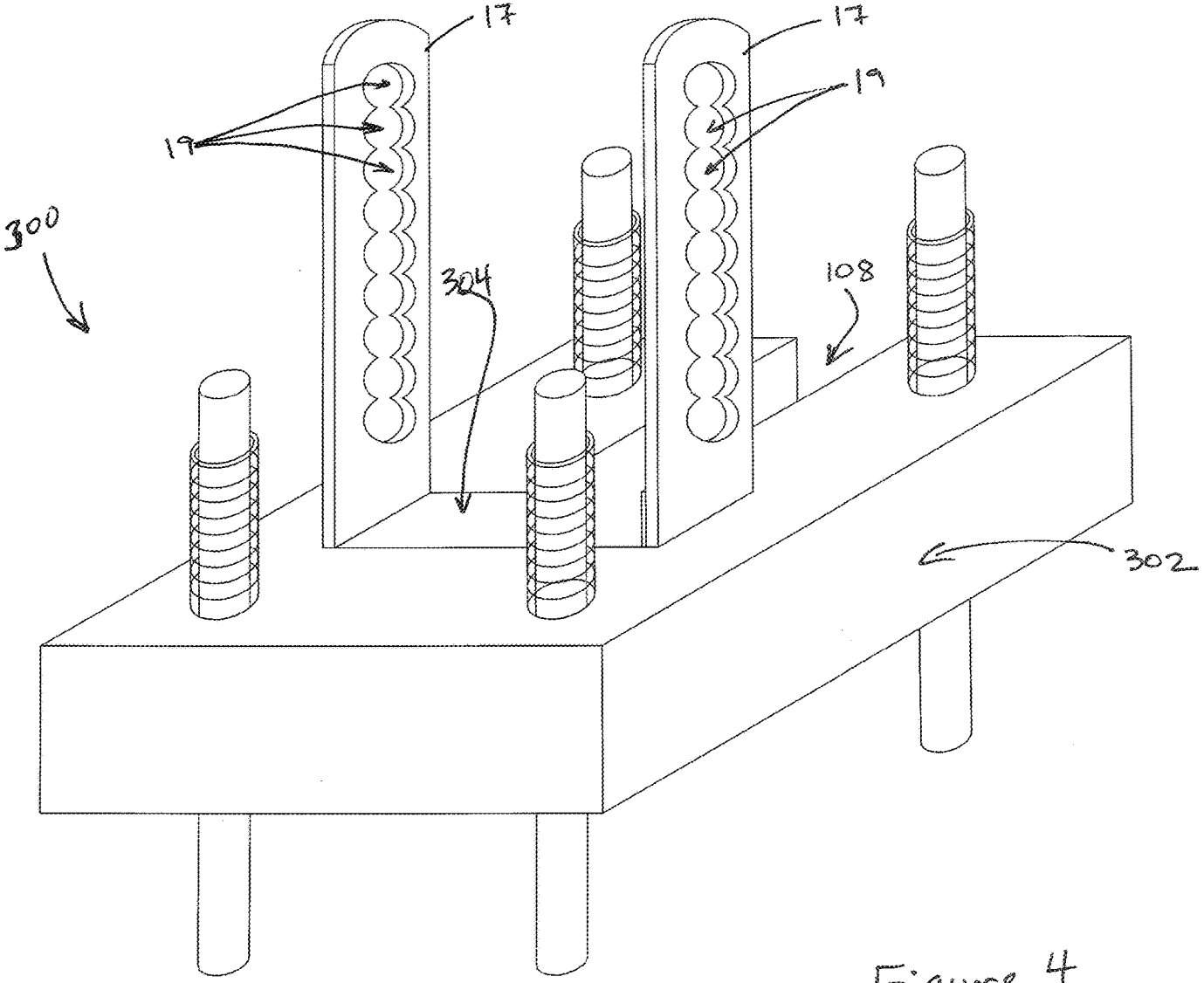
FIG. 4 shows an embodiment of the alignment head with connection rails for connecting to a fastener installation tool.
Figure 6:
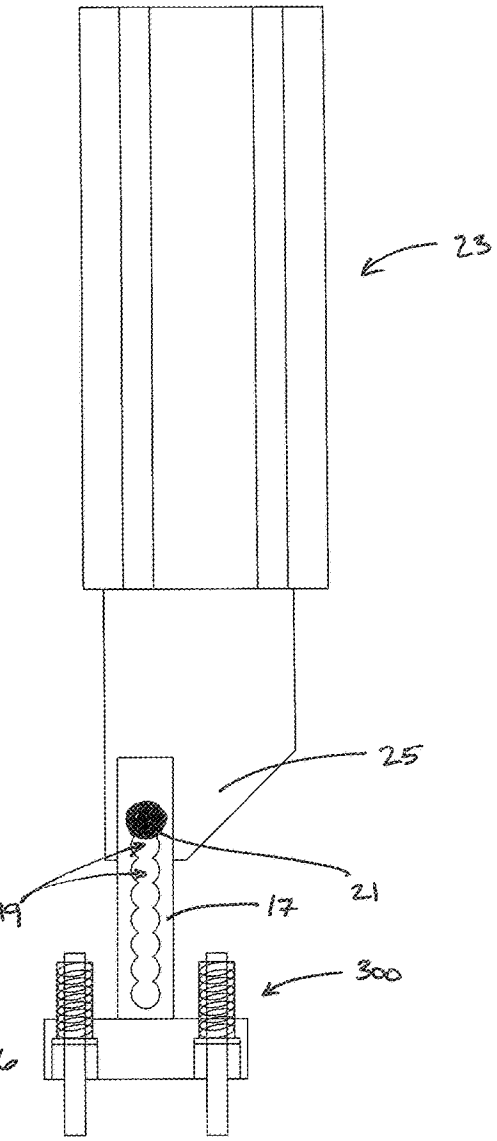
FIG. 6 is a side view of the alignment head connected to the installation tool
Figure 5:
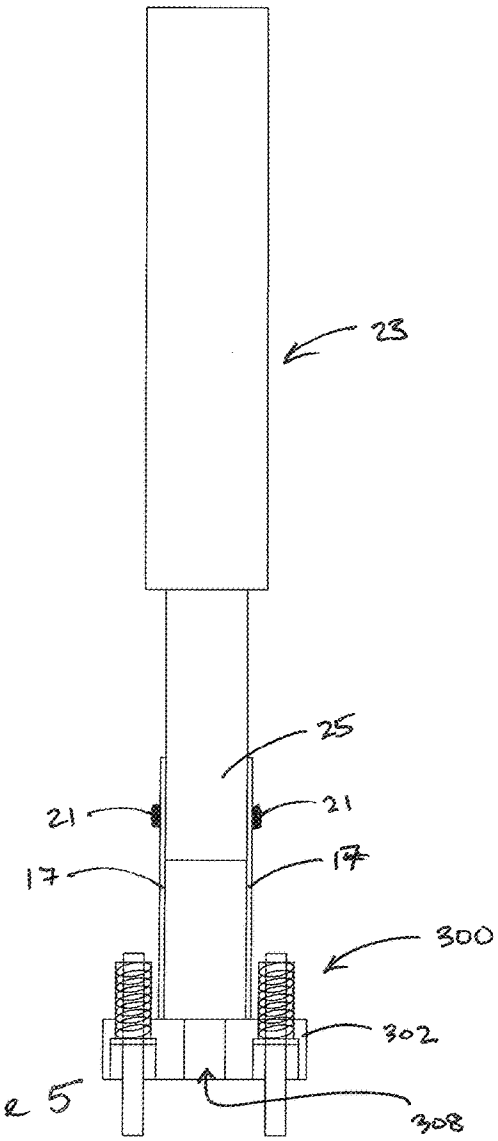
FIG. 5 is a rear view of the alignment head connected to a fastener installation tool for use.

With reference to FIGS. 4-6, another embodiment of the alignment head 300 is mountable to an automatic fastener feed installation tool proximate its central opening 304. The alignment head 300 mounts includes a pair of brackets 17 that project from the platform 302 from the central opening 304. Each of the brackets 17 defines an elongate series of holes 19, each for receipt of an attachment screw 21 on the nose 25 of an installation tool 23. The attachment screws 21 are loosened to allow vertical reciprocation of the head 300 and then tightened to clamp the brackets 17 when the head 300 is at the appropriate height to secure the head to the nose 25. When mounted, the channel 308 of the platform 302 extends in a rearward direction. The channel 308 provides sufficient headroom for collated fasteners to traverse the platform 302 to align a frontmost fastener with the central opening 304. An arcuate groove, like that depicted in earlier Figures as reference numeral 25 may be included to minimize the potential for the platform 302 to interfere with the passage of the collated fasteners through the channel 308. In operation, the collated fasteners travel through the channel 308 until they reach the central opening 304 where they are driven by the installer into the deck board $B_3$ and the underlying support joist. The elongate vertical alignment of the holes 19 in the brackets 17 allow vertical adjustment of the alignment head 100 as desired for a specific tool or use.

Figure 7:
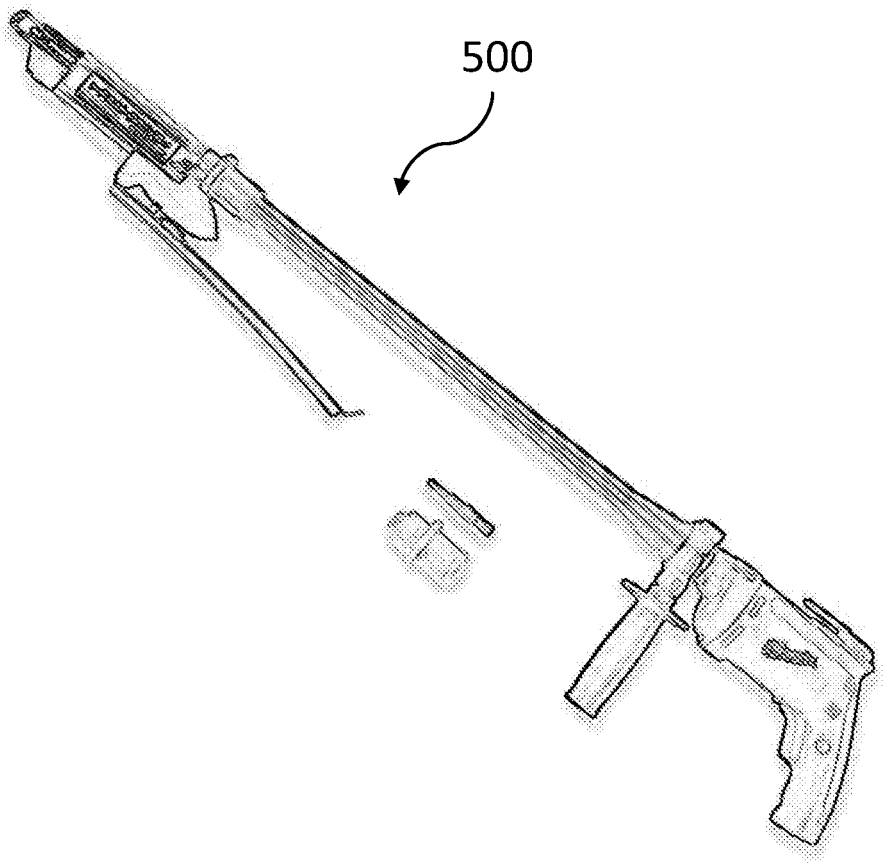
FIG. 7 shows a side view of a representative automatic fastener feed installation tool suitable for use with a disclosed alignment head.
Figure 8:
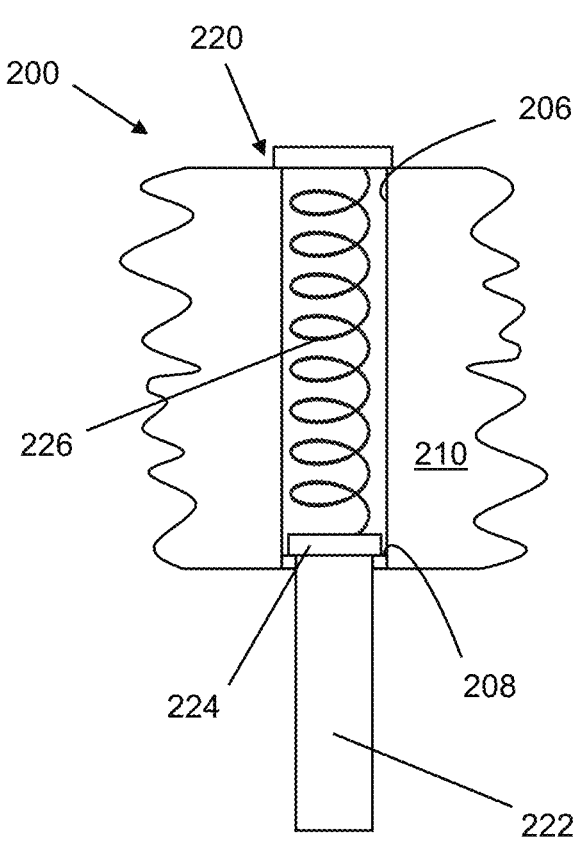
FIG. 8 is an enlarged fragmentary sectional view, partly in schematic, of an alternative embodiment of an alignment head with a retractable guide leg protruding downwardly.

With reference to FIGS. 7-8, in an alternative embodiment of the alignment head 200, counterbores 206 are formed in the platform 210. The counterbore transition forms a rim 208 at a lower portion. The retractable guide assemblies 220 each have a pin 222 with an integral flange-like head 224. A coiled spring 226 engages the pin head 224 to bias the pin downwardly to project below the platform 210. The maximum projection is defined by the underside of the head 224 engaging the rim 208. A shroud is not employed, and the retractable guide pin 222 in the retracted mode is entirely housed within the platform. See FIG. 11. In this embodiment, the platform 210 may have a greater thickness to properly house the pin 222 in the extended state so that it will extend below the surface of the platform at a sufficient distance. The attachment 200 may employ the rectangular matrix of pins as previously described for alignment head 50, a trapezoidal matrix as previously described for alignment head 100, or other matrix of pins.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. An alignment head comprising:

a platform defining an opening;

a matrix of retractable guide assemblies mounted to the platform offset from the opening;

each retractable guide assembly comprising a pin biased to project downwardly below the platform and having a lower end with a maximum effective diameter d;

wherein each pin protrudes downwardly below the platform when the pin is not in contact with an adjacent underlying surface below the platform, and each pin retracts upwardly into the platform when the pin lower end is in contact with an adjacent underlying surface below the platform.

2. The alignment head of claim 1 wherein each retractable guide assembly is radially offset from the opening of the platform.

3. The alignment head of claim 1 wherein each retractable guide leg comprises a pin enclosed and biased by a coiled spring disposed within a shroud.

4. The alignment head of claim 1 wherein there are four parallel retractable guide assemblies defining a rectangular matrix comprising two equidistantly spaced pairs of guide pins wherein the pins of each pair are each spaced an equal distance from each other.

5. The alignment head of claim 1 wherein the opening leads to a channel extending out to a side of the platform.

6. The alignment head of claim 1 wherein the opening is quasi-annular and leads to a channel extending out to a side of the platform.

7. The alignment head of claim 1 wherein the central opening is quasi-rectangular and communicates with a channel extending out to a side.

8. The alignment head of claim 1 wherein the platform has a top and a bottom surface, said bottom surface defining a planar reference.

9. The alignment head of claim 8 wherein the top surface includes an arcuate groove.

10. The alignment head of claim 1 wherein the matrix is rectangular.

11. The alignment head of claim 1 wherein the matrix is trapezoidal.

12. An alignment head for positioning a fastener for installing a deck board to a support joist having a width W comprising:

a platform defining an opening;

a matrix of retractable guide assemblies mounted to the platform with at least one pair having a spacing equal the width W;

each retractable guide assembly comprising a pin biased to project downwardly below the platform and having a lower end with a maximum effective dimension d;

wherein each pin protrudes downwardly below the platform when the pin is not in contact with an adjacent underlying surface below the platform and each pin retracts upwardly into the platform when the pin lower end is in contact with an adjacent underlying surface below the platform and the opening defines a position located on a medial line of said spacing.

13. The alignment head of claim 12 wherein each retractable guide pin is offset from the opening of the platform.

14. The alignment head of claim 12 wherein each retractable guide assembly comprises a pin biased by a coiled spring.

15. The alignment head of claim 12 wherein there are four parallel retractable guide assemblies defining a rectangular matrix comprising two equidistantly spaced pairs of guide pins wherein the pins of each pair are each spaced an equal distance W from each other.

16. The alignment head of claim 12 wherein the opening leads to a channel extending out to a side of the platform.

17. An alignment head for positioning a fastener to fasten a deck board overlying a support joist having a width W comprising:

a platform defining an opening;

a matrix of retractable guide assemblies mounted to the platform and offset from the opening;

each retractable guide leg comprising a member biased to project downwardly below the platform and having a lower end;

wherein when at least a portion of the platform rests on a deck board overlying a support joist, each member protrudes downwardly below the platform when the member is not in contact with the deck board and engages opposing sides of said support joist and each member retracts upwardly into the platform when the member lower end is in contact with the deck board and the opening defines a fastener entry position through a medial vertical plane of said joist.

18. The alignment head of claim 17 wherein there are two pairs of retractable guide assemblies and each pair has members spaced to engage opposing sides of the support joist.

19. The alignment head of claim 17 wherein each retractable guide assembly comprises a member enclosed and biased by a coiled spring and wherein each member has a uniform lower dimension d which defines a spacing between adjacent deck boards.

20. The alignment head of claim 19 wherein there are four parallel retractable guide assemblies defining a trapezoidal matrix comprising two equidistantly spaced pairs of members wherein the member of each pair are each spaced an equal distance from each other.

* * * * *